US010143314B2

(12) United States Patent
Strochinsky

(10) Patent No.: US 10,143,314 B2
(45) Date of Patent: Dec. 4, 2018

(54) DISPLAYING APPARATUS

(71) Applicant: Greg Strochinsky, Cincinnati, OH (US)

(72) Inventor: Greg Strochinsky, Cincinnati, OH (US)

( * ) Notice: Subject to any disclaimer, the term of this patent is extended or adjusted under 35 U.S.C. 154(b) by 127 days.

(21) Appl. No.: 15/163,277

(22) Filed: May 24, 2016

(65) Prior Publication Data

US 2017/0340143 A1 Nov. 30, 2017

(51) Int. Cl.

| | |
|---|---|
| ***A47F 7/00*** | (2006.01) |
| ***A47F 5/08*** | (2006.01) |
| ***A47F 5/16*** | (2006.01) |
| ***A47B 96/02*** | (2006.01) |
| ***A47G 33/00*** | (2006.01) |

(52) U.S. Cl.

CPC ..... *A47F 5/08* (2013.01); *A47B 96/027* (2013.01); *A47G 33/00* (2013.01)

(58) Field of Classification Search

CPC ..... A47F 2007/0092; A47F 7/00; A47F 5/08; A47F 5/16; A63F 3/00031

USPC ..... 211/85.7; D6/552; D11/132, 133

See application file for complete search history.

(56) References Cited

U.S. PATENT DOCUMENTS 613,658 A * 11/1898 Bourke ..... A63F 3/00031 273/244.1
1,409,033 A * 3/1922 Smiley ..... A63F 3/00031 273/244.1
1,518,030 A * 12/1924 Waller ..... A63F 3/00031 273/244.1
1,685,428 A * 9/1928 Lowry ..... A63F 7/0608 273/317.7
2,145,664 A * 1/1939 Ristow ..... A63B 71/0672 116/222
2,462,170 A * 2/1949 Dube ..... A63F 7/0608 273/108.32
D177,505 S * 4/1956 Jenkins ..... D11/131
3,695,452 A * 10/1972 Surman ..... A47F 7/024 206/461
3,949,506 A * 4/1976 Benkowski ..... A63B 71/0672 40/1.6
3,957,269 A * 5/1976 Bouchard ..... A63F 3/00031 273/244.2
4,002,241 A * 1/1977 Parrilla, Sr. ..... A47F 7/00 211/14
4,452,453 A * 6/1984 Daley ..... A63F 3/00031 273/244.1
4,708,344 A * 11/1987 Wyatt ..... A63F 3/00031 273/244.1
D306,385 S * 3/1990 Alexander ..... D6/552
D309,226 S * 7/1990 Wilcox ..... D6/552
4,944,968 A * 7/1990 Wagner ..... A47G 23/0303 40/776
D333,846 S * 3/1993 Graham ..... D20/40
5,201,520 A * 4/1993 Castle ..... A63F 7/0608 273/317.9

(Continued)

*Primary Examiner* — Stanton L Krycinski
(74) *Attorney, Agent, or Firm* — Taft Stettinius & Hollister LLP; Derek B. Lavender

(57) ABSTRACT

A display apparatus having a base member with an outer surface, outer boundaries defined by the base member, and at least one platform extending from the outer surface of the base member and defining an upper surface. Wherein the outer boundaries of the base member define a scene and the at least one platform is positioned along the base member at a location that corresponds with the scene.

13 Claims, 4 Drawing Sheets

(56) References Cited

U.S. PATENT DOCUMENTS

D339,237 S * 9/1993 Korte ..... D6/301
D339,259 S * 9/1993 Kocon ..... D6/552
D339,494 S * 9/1993 Kocon ..... D6/552
5,249,683 A * 10/1993 Baucom ..... B65D 73/0057 206/462
5,379,976 A * 1/1995 DeGirolamo ..... B25H 3/04 248/220.43
5,388,353 A * 2/1995 Givnan ..... G09F 1/10 40/737
5,407,204 A * 4/1995 Meyer, III ..... A63F 3/00031 273/148 A
5,413,228 A * 5/1995 Le Clerc ..... A47G 1/0616 211/13.1
5,419,062 A * 5/1995 Polinski ..... G09F 7/10 40/124.4
D361,455 S * 8/1995 Eason ..... D6/301
D366,584 S * 1/1996 Ellis ..... D6/552
D366,798 S * 2/1996 Messersmith ..... D21/356
5,664,780 A * 9/1997 Bricker ..... A63B 71/06 116/222
D393,603 S * 4/1998 Cerisano ..... D11/132
5,746,332 A * 5/1998 Kleinschmidt ..... A47F 7/0028 108/25
D397,897 S * 9/1998 Tipton ..... D6/563
5,819,457 A * 10/1998 Parker ..... A63B 71/0672 40/620
D417,113 S * 11/1999 Greaney ..... D6/552
6,016,910 A * 1/2000 Rodearmel ..... G09F 19/00 206/315.1
D422,439 S * 4/2000 Chen ..... D6/552
6,220,441 B1 * 4/2001 Cook ..... A45C 13/08 206/315.1
6,419,227 B1 * 7/2002 Barnhardt ..... A63F 3/00031 273/236
D470,894 S * 2/2003 Oister ..... D21/315
6,530,571 B1 * 3/2003 McWilliams ..... A63F 3/00031 273/244.2
6,722,070 B2 * 4/2004 Ribaudo ..... B44C 5/005 40/735
D540,547 S * 4/2007 Barnhorn ..... D6/303
D543,758 S * 6/2007 Olivera ..... D6/552
D557,629 S * 12/2007 Maes ..... D11/133
7,354,040 B2 * 4/2008 Schneider ..... A63F 3/00 273/239
D574,268 S * 8/2008 Cowen ..... D10/46.1
D585,773 S * 2/2009 Cowen ..... D10/46.1
D596,236 S * 7/2009 Hackes ..... D10/46.1
D768,773 S * 10/2016 Foxcroft ..... D19/88
D768,775 S * 10/2016 Foxcroft ..... D19/113
2001/0047973 A1 * 12/2001 Schmidt ..... A47F 5/16 211/90.04
2006/0043673 A1 * 3/2006 Brown ..... A63B 71/06 273/239
2008/0283482 A1 * 11/2008 Torke ..... A47F 7/0028 211/153
2010/0052254 A1 * 3/2010 Hsu ..... A63F 3/00031 273/277
2017/0007041 A1 * 1/2017 Amos, III ..... A47F 5/08

* cited by examiner

DISPLAYING APPARATUS

TECHNICAL FIELD

The present teachings are related to a displaying apparatus, and more particularly to a displaying apparatus that can be hung from a vertical surface and display figurines.

SUMMARY

One embodiment is a display apparatus, having a base member having an outer surface, an outer boundary defined by the base member, and a platform extending from the outer surface of the base member and defining an upper surface for holding a display article. The outer boundary of the base member defines a display area and the platform is positioned along the base member at a location that corresponds with a pre-defined location of the display area.

Another embodiment is wall display, having a base member sized to represent a display area, and a platform extending perpendicularly from the base member to define an upper surface. The platform is positioned on the base member at a location that correlates with a location from the display area. Further, the upper surface is sized to allow a figurine to be placed thereon without contacting the base member when the base member is in a substantially vertical orientation.

Another embodiment is a figurine displaying kit having a base member having an outer surface, a plurality of platforms extending from the outer surface of the base member, each defining an upper surface, and at least one figurine having a three-dimensional shape. The outer boundaries of the base member define a display area and the plurality of platforms are positioned along the base member at locations that corresponds with the display area. Further, the figurine correlates with the location of only one of the plurality of platforms.

DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The above-mentioned aspects of the present application and the manner of obtaining them will become more apparent and the teachings of the present application itself will be better understood by reference to the following description of the embodiments of the present application taken in conjunction with the accompanying drawings.

Figure 1:
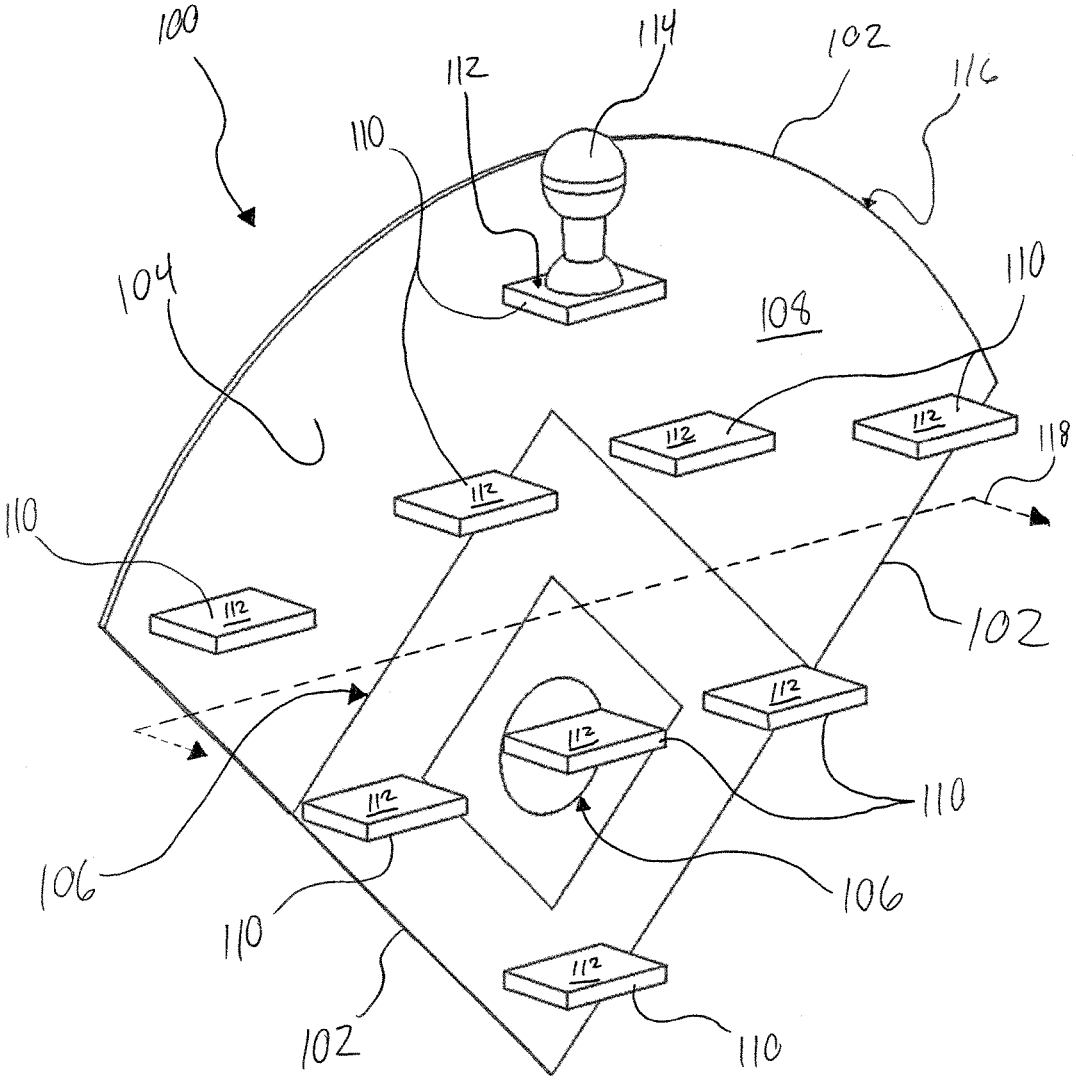
FIG. 1 is a perspective view of one embodiment of a displaying apparatus in accordance with one illustrative aspect of the present disclosure.

Referring now to FIG. 1, a display apparatus 100 is shown. The display apparatus 100 may be generally in the outline of the boundaries for a recreational activity, athletic game, or other known area. In the embodiment shown in FIG. 1, the display 100 may generally have outer boundaries 102 that form a baseball diamond. The display apparatus 100 may be formed from a substantially planar base member 104 that extends between the boundaries 102 to form the baseball diamond. The base member 104 may also have one or more marking or other indicia 106 formed or otherwise displayed on an outer surface 108 to identify different aspects of the recreational activity, athletic game, or known area. The indicia 106, along with the outer boundaries 102, may clearly indicate to a user the particular type of recreational activity, athletic game, or known area that is intended to be shown by the base member 104. The base member 104 may be configured to be positioned in a substantially vertical orientation, with the outer surface 108 being substantially perpendicular to a horizontal plane 118. In the embodiment of FIG. 1, in addition to the outer boundaries 102 outlining the baseball diamond, the indicia 106 may also identify a pitcher's mound, a base path, infield dirt, or other recognizable part of a baseball diamond on the outer surface 108. Accordingly, the display apparatus 100 of FIG. 1 utilizes the outer boundaries 102 and the indicia 106 to identify to a user that the display apparatus 100 represents a baseball diamond scene or display area.

Also coupled to the base member 104, or integrally formed therewith, may be at least one platform 110. The platform 110 may extend from the outer surface 108 of the base member 104 to provide an upper surface 112 on which a display article or figurine 114 may be positioned. The platform 110 may have sufficient material properties and dimensions to support the figurine 114 when placed on the upper surface 112. In one non-exclusive embodiment, the platform 110 may have a thickness of about a half-inch. However, the thickness of the platform 110 may be any thickness suitable to support the figurine 114 and may vary depending on the material composition of the platform 110 and the base member 104. More specifically, if the platform 110 and base member 104 are formed of a metal such as steel, aluminum, or any other metal or metal alloy, the platform 110 may be much thinner than a half-inch and still able to support the figurine 114. Alternatively, if the platform 110 and base member 104 are formed of weaker material such as wood, Styrofoam, plastic, or any other similar material, the platform 110 may be thicker than a half-inch to support the figurine 114.

The base member 104 may have a thickness sufficient to maintain the size and shape of the base member 104 without substantially deforming or otherwise bending relative to the base member 104. While the thickness of the base member 104 may vary depending on the material composition of the base member 104, in one embodiment the base member 104 may be about a quarter-inch thick. Further, the base member 104 may be formed of any material with sufficient material properties to maintain the platforms 110 in the proper position. More specifically. The base member 104 may be made of wood, metal, plastic, cardboard, Styrofoam, or any other similar material. Further, the base member 104 may be made of the same material, or a different material, than the platform 110. Further still, in one non-exclusive embodiment the base member 104 may have the platforms 110 integrally formed therein.

In one aspect of the present disclosure, the display apparatus 100 may be a wall display. In this embodiment, the base member 104 may have a hanger (not shown) positioned on, or within, a portion of a back surface 116 of the base member 104. The hanger may be along a substantially central portion of the base member 104 so the base member 104 may be hung from a single point on a vertical surface and remain oriented as desired. However, in other embodiments there may be multiple hangers positioned along the back surface 116. In one embodiment, the hanger may be coupled to the back surface 116 and have one or more V-shaped pockets able to receive a portion of a nail, screw, or other similar component that extends from the vertical surface. In this embodiment, the base member 104 may be hung in substantially the same way as many pictures are hung. Similarly, in one embodiment a wire may extend across the back surface 116 and be coupled to the base member 104 at either side. The wire may be positioned along the nail, screw, or other similar component that is extending from the vertical surface to maintain the base member 104 in substantially a vertical position along the wall. In yet another embodiment, a cavity may be formed in a portion of the back surface 116 to allow the nail, screw, or other similar component that is coupled to the horizontal surface to become at least partially positioned therein to hang the base member 104 to the wall. A person skilled in the relevant art understands the many ways the base member 104 can be coupled to a wall or other vertical or angularly offset surface and this disclosure is not limited to any particular type of hanger.

The platform 110 may be coupled to the base member 104 in a plurality of different ways, and this disclosure is not limited to any particular way of coupling the platform 110 to the base member 104. In one embodiment, the platform 110 may be coupled to the base member 104 by welding the platform 110 to the outer surface 108 of the base member 104. In another embodiment, the platform 110 may be glued to the outer surface 108 of the base member 104 using any adhesive known in the art appropriate for the particular materials used for the base member 104 and the platform 110. Further still, in another embodiment the base member 104 may have through-holes defined therein that correspond with the cross-sectional size of the platform 110. In this embodiment, the platform 110 may be positioned at least partially within the through-hole. Further, the platform 110 may be press-fit into the through-hole of the base member 104 to become coupled thereto. Additionally, any of the coupling methods described above can be used in addition to positioning the platform 110 at least partially within the base member 104. In yet another embodiment, one or more fasteners may couple the platform 110 to the base member 104. More specifically, a threaded screw may be driven through the base member 104 at a back surface and into the platform 110. A head of the threaded screw may become positioned adjacent to the back surface while threads of the threaded screw pull the platform 110 towards the outer surface 108 as the threaded screw rotates. In yet another embodiment, an L-shaped bracket can be coupled to each of the base member 104 and the platform 110 to maintain the proper relationship between the base member 104 and the platform 110. More specifically, any of the couplers described above may be used to couple the corresponding portions of the L-bracket to the base member 104 and the platform 110 to couple the platform to the base member 104 at the proper location.

Figure 2:
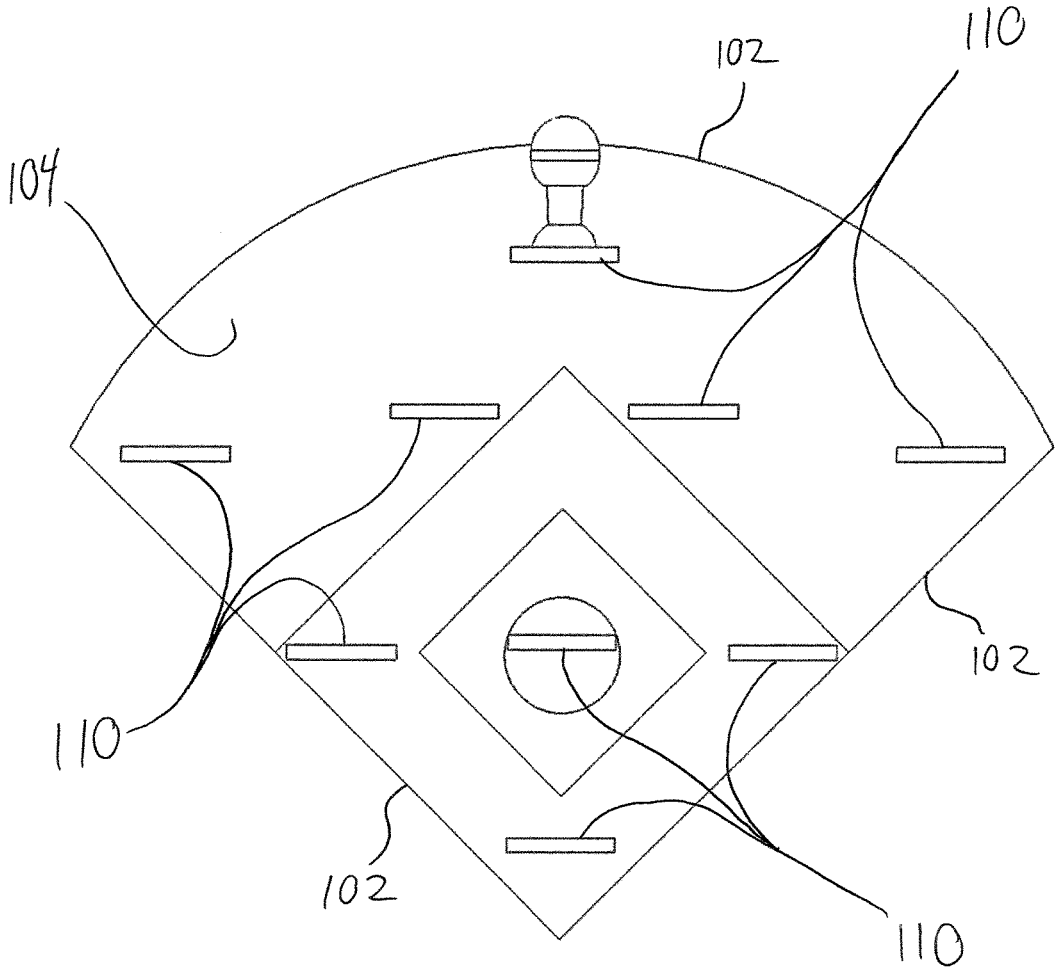
FIG. 2 is a front view of the displaying apparatus from FIG. 1.

Now referring to FIG. 2, the platforms 110 may be spaced about the base member 104 to represent specific locations of the display apparatus 100 that may correlate with the shape of the base member 104. More specifically, in the embodiment shown in FIG. 1, the base member 104 may have boundaries 102 that the user may identify as representing a baseball diamond as described above. Further, the location of the platforms 110 about the base member 104 may also be spaced to represent positions baseball players typically occupy on a baseball field when playing defense. More specifically, the platforms 110 may be positioned at a location representative of the traditional locations for the catcher, pitcher, first base, second base, third base, short stop, left field, center field, and right field.

Figure 3:
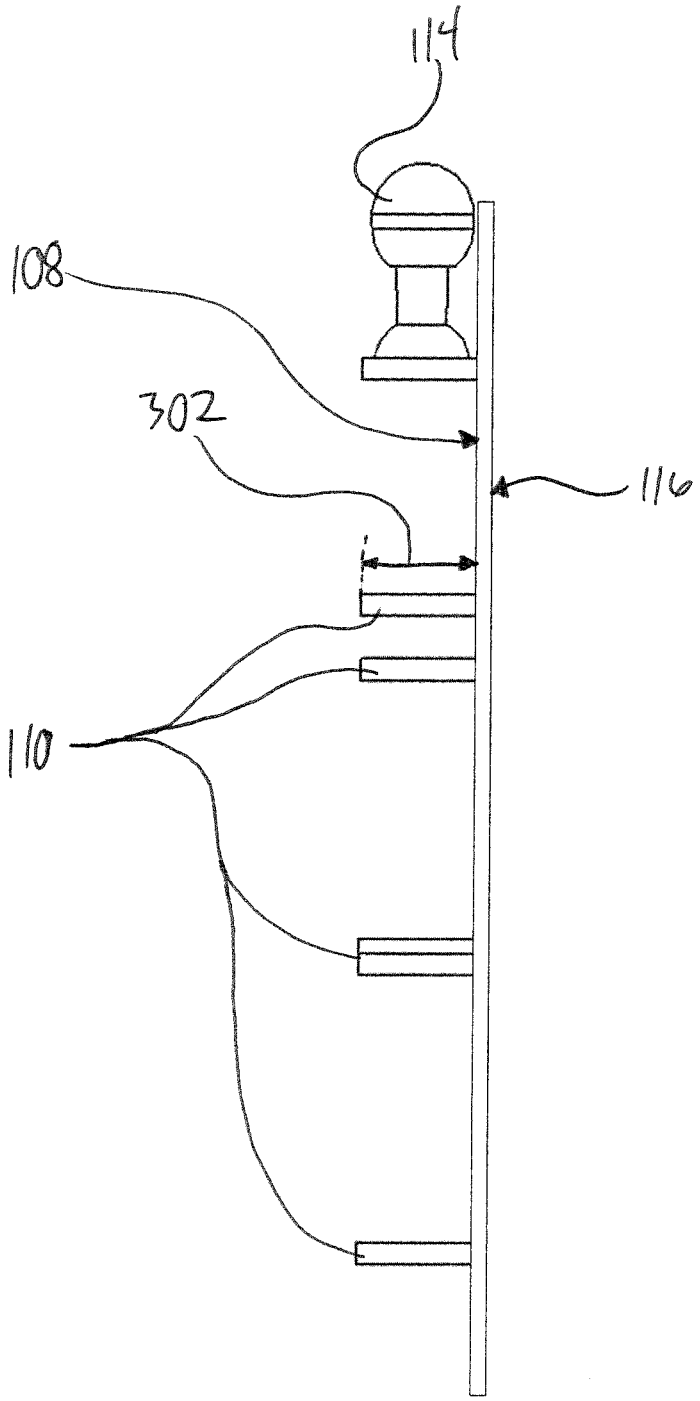
FIG. 3 is a side view of the displaying apparatus from FIG. 1.
Figure 4:
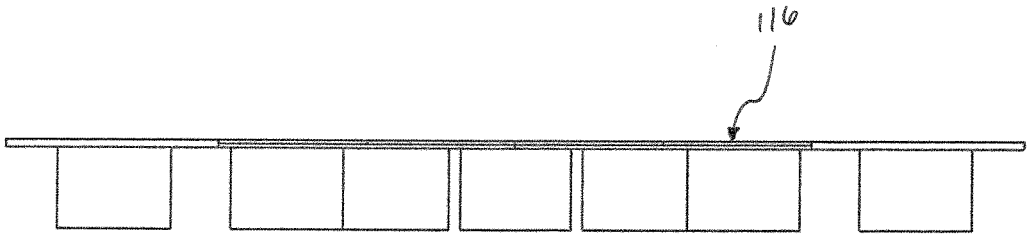
FIG. 4 is a bottom view of the displaying apparatus from FIG. 1.
Figure 5:
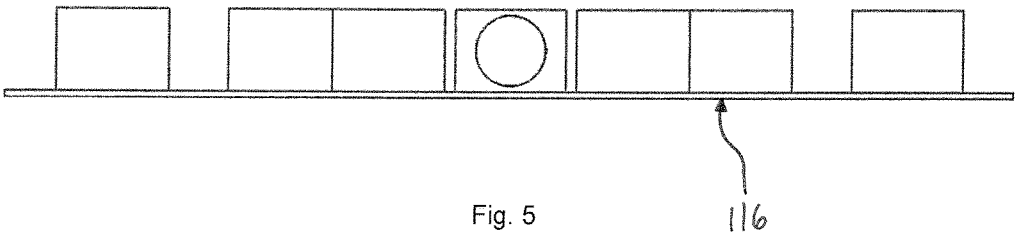
FIG. 5 is a top view of the displaying apparatus from FIG. 1.

Referring now to FIG. 3, a side view of the display apparatus 100 is shown. In the side view of FIG. 3, a width 302 of the platforms 110 is shown. The width 302 may be the distance that the platform 110 extends away from the outer surface 108. In one non-exclusive example, the width 302 may be about two and three-quarters of an inch. However, the particular width 302 is not limited to such a dimension. More specifically, the width 302 may be any dimension sufficient to allow the three-dimensional figurine 114 to be placed thereon and stand substantially vertically on the platform 110. More specifically, in one embodiment the figurine 114 may only touch the platform 110 and not contact the outer surface 108 at all.

While the base member 104, boundaries 102, and platform 110 locations have been described above for indicating a baseball diamond scene or display area, this disclosure is not limited to such a configuration. More specifically, in other embodiments the base member 104 may have boundaries 102 shaped like a full or partial basketball court. Further, there may be only five platforms 110 positioned along the base member 104 that represent positions typically occupied by basketball players. Alternatively, in other embodiments the base member 104 may have boundaries 102 shaped like a full or partial soccer field. Further, there may be eleven platforms 110 positioned along the base member 104 that represent positions typically occupied by soccer players. In yet another embodiment, the base member 104 may have boundaries 102 shaped like a full or partial football field. Further, there may be eleven platforms 110 positioned along the base member 104 that represent positions typically occupied by football players. In yet another embodiment, the base member 104 may have boundaries 102 shaped like a full or partial ice hockey rink. There may be six platforms 110 positioned along the base member 104 that represent positions typically occupied by ice hockey players. In yet another embodiment, the base member 104 may have boundaries 102 shaped like a full or partial cricket field. There may be eleven platforms 110 positioned along the base member 104 that represent positions typically occupied by cricket players.

In a different embodiment, the base member 104 may have boundaries 102 that represent a recognizable scene or display area outside of athletics such as scenes from a popular landscape, movie, comic, book, video game, card game, board game, or any other similarly recognizable scene. As described above, indicia 106 may be added to the base member 104 to further identify the particular scene or display area being represented. Further still, in this embodiment the platforms 110 may be spaced from one another to position figurines 114 thereon at relevant portions of the base member 104. As one non-limiting example, the base member 104 may have boundaries 102 shaped like a spaceship from a sci-fi movie. The platforms 110 may be positioned along the base member 104 at locations that are significant to the space ship; for example at a location for a captain or gunner. Similarly, the base member 104 may have boundaries 102 representing a popular scene from a movie with the platforms 110 located in areas within the scene where the characters of the movie were located. In this embodiment, the user may identify the scene based on the base member 102 and indicia 106 and determine where a particular type of figurine 114 should be positioned.

More specifically, the figurine 114 may be a separate component that can be placed on, or removed from, the respective platform 110. Further, the figurine 114 may be any three-dimensional component that represents a person or other identifier that the user may relate to the display apparatus 100. In the embodiment shown in FIG. 1, the figurine 114 may be a bobblehead-type figurine that represents a particular baseball player. The baseball player identified by the figurine 114 may be associated with a particular position on the field. Accordingly, the user may understand that the particular baseball player figurine 114 is associated with the center field position, and therefore the figurine 114 should be placed on the platform 110 that is positioned at the center field position on the base member 104.

The display apparatus 100 is not limited to applying to baseball player figurines 114. More specifically, the figurine 114 may represent a particular player for any of the sports or recreational activities described above. Further still, the figurines 114 may represent characters associated with the scene or display area of the base member 104 when the base member 104 is not shaped like an athletic event. More specifically, the base member 104 may represent a general scene or display area recognizable by the user and the figurine 114 may represent a particular character associated with a particular location within the scene or display area. Further, the platforms 110 may be spaced about the base member 104 at the particular locations identifiable within the scene or display area. The base member 104 and the figurine 114 may indicate to the user that the figurine 114 belongs on the particular base associated with the scene or display area of the base member 104. Accordingly, the user may place a different figurine 114 on each of the platforms 110 to associate each figurine 114 with their respective position within the scene shown by the base member 104.

While an exemplary embodiment incorporating the principles of the present application has been disclosed hereinabove, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations).

What is claimed is:

1. A display apparatus, comprising:

a base member having an outer surface;

an outer boundary defined by the base member and outlining a baseball diamond; and nine platforms extending from the outer surface of the base member and each of the nine platforms defining an upper surface for holding a display article;

wherein, the display article is a three-dimensional figurine that resembles the human body of a particular baseball player that is associated with only one of the platforms;

wherein each one of the nine platforms is positioned along the base member at a different location that corresponds with a defensive position on the baseball diamond;

further wherein, only one of the nine platforms represents a common defensive position of the figurine that correlates with the particular baseball player's defensive position and the figurine is configured to be maintained on display on only one of the nine platforms.

2. The display apparatus of claim 1, wherein the different locations corresponding with a defensive position on the baseball diamond at which each one of the nine platforms is positioned along the base member includes each one of a catcher position, a pitcher position, a first base position, a second base position, a third base position, a short stop position, a left field position, a center field position, and a right field position.

3. The display apparatus of claim 1, wherein each one of the nine platforms extends substantially perpendicularly from the outer surface and the upper surface has a width sufficient to receive the display article.

4. The display apparatus of claim 1, further comprising indicia formed on the base member.

5. The display apparatus of claim 1, wherein the base member has a hanger positioned to hang the base member from a substantially vertical surface.

6. A surface display, comprising:

a base member having a display area that is baseball diamond shaped;

nine platforms extending perpendicularly from the base member, each of the nine platforms defining an upper surface and positioned at a location that correlates with a defensive position on the baseball diamond; and a three-dimensional bobble-head figurine of a baseball player, the figurine being a particular baseball player known for playing at one of the defensive positions of the nine platforms;

wherein the upper surface is sized to allow the figurine to be placed thereon without contacting the base member when the base member is in a substantially vertically orientation;

further wherein the figurine is not properly displayed on any of the nine platforms other than the platform associated with the baseball player's known defensive position.

7. The surface display of claim 6, wherein the base member further comprises a hanger.

8. The surface display of claim 6, comprising indicia on the display area.

9. The surface display of claim 8, wherein the indicia represents a pitcher's mound.

10. The surface display of claim 8, wherein the indicia represents a base path.

11. The surface display of claim 6, wherein the defensive positions include a catcher position, a pitcher position, a first base position, a second base position, a third base position, a short stop position, a left field position, a center field position, and a right field position.

12. A baseball figurine displaying kit, comprising:

a base member having an outer surface and a boundary in the shape of a baseball diamond;

nine platforms extending from the outer surface of the base member, each of the nine platforms defining an upper surface and being positioned at a location that correlates with a defensive baseball position on the base member; and at least one bobble-head figurine having a three-dimensional shape that resembles a particular baseball player that is known for playing a particular defensive baseball position;

wherein, the at least one figurine is properly displayed on only the one of the nine platforms having the particular defensive baseball position of the particular baseball player and is not properly displayed on any other of the nine platforms.

13. The figurine displaying kit of claim 12, wherein each of the plurality of platforms is substantially horizontal when the base member is in a vertical position.

* * * * *